US005739459A

United States Patent [19]

La Mura et al.

[11] Patent Number: 5,739,459

[45] Date of Patent: Apr. 14, 1998

[54] PYROTECHNIC IGNITION APPARATUS

[75] Inventors: Joseph L. La Mura, West Caldwell; Ronald Conrad Wallenburg, Pennsauken, both of N.J.

[73] Assignee: Joanell Laboratories, Inc., Livingston, N.J.

[21] Appl. No.: 543,313

[22] Filed: Oct. 16, 1995

Related U.S. Application Data

[63] Continuation of Ser. No. 447,077, May 22, 1995, Pat. No. 5,559,303, which is a continuation of Ser. No. 145,499, Nov. 1, 1993, Pat. No. 5,450,686, which is a division of Ser. No. 877,809, May 4, 1992, Pat. No. 5,284,094, which is a division of Ser. No. 419,549, Oct. 10, 1989, Pat. No. 5,157,222.

[51] Int. Cl.[6] ..... F41A 19/65; F41A 19/68

[52] U.S. Cl. ..... 102/217; 102/360; 89/28.05

[58] Field of Search ..... 89/1.41, 1.814, 89/28.05, 36.17; 102/355, 360, 217; 73/167; 434/11, 16

[56] References Cited

U.S. PATENT DOCUMENTS

| | | | |
|---|---|---|---|
| 1,282,120 | 10/1918 | Patterson | 73/167 |
| 2,537,096 | 1/1951 | Shreeve, Jr. et al. | 73/167 |
| 2,741,161 | 4/1956 | Musser | 89/28.05 |
| 3,208,350 | 9/1965 | Robinson | 89/34 |
| 3,535,809 | 10/1970 | Hoffman | 42/106 |
| 3,722,418 | 3/1973 | Hoffman | 42/106 |
| 4,217,717 | 8/1980 | Canty et al. | 42/84 |
| 4,245,403 | 1/1981 | Hipp | 102/355 |
| 4,439,155 | 3/1984 | Roe | 102/334 |
| 4,463,310 | 7/1984 | Whitley | 324/73 PC |
| 5,157,222 | 10/1992 | La Mura et al. | 102/355 |

FOREIGN PATENT DOCUMENTS

| | | | |
|---|---|---|---|
| 958473 | 3/1950 | France | 89/28.05 |

*Primary Examiner*—Stephen M. Johnson

[57] ABSTRACT

A plurality of magazines each receive an array of pyrotechnic devices. The magazines are latched to a fire control and support assembly which automatically engages the fire control circuit to each device of each magazine. The circuit ignites all devices of all the magazines in a given serial sequence. The system, under control of an operator, when turned off, may be restarted at the beginning of a selected sequence, at the point where the last device was ignited and continue the sequence or at selected different portions of devices. Different size devices can be ignited by one circuit using different magazines all coupled to one unit. Safety features also include delay ignition after startup and sounding an alarm before any device is ignited. A CPU is enabled by a fire command signal and disabled by internal programmed instructions. The CPU is periodically enabled in a device ignition cycle by external timing signals initiated by the CPU when enabled.

6 Claims, 11 Drawing Sheets

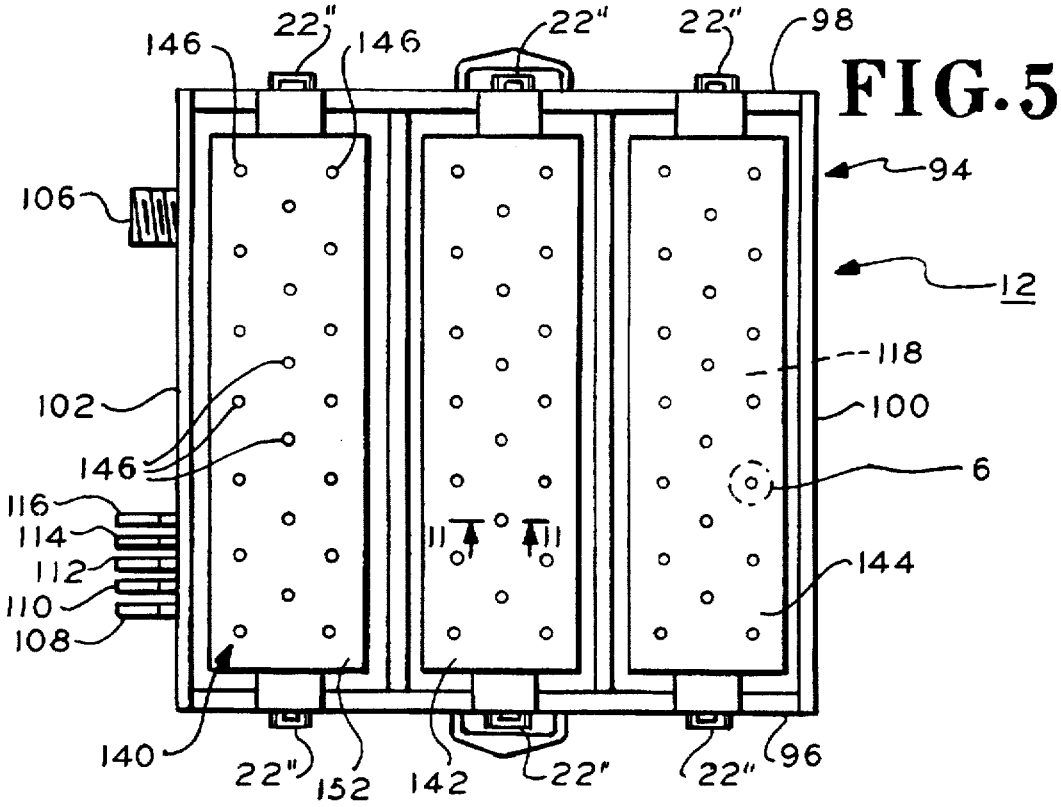
FIG.5
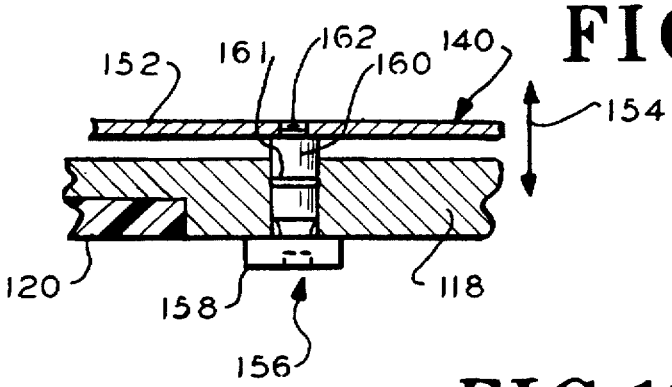
FIG.9
FIG.8a
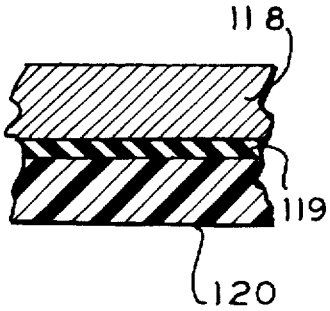
FIG.10
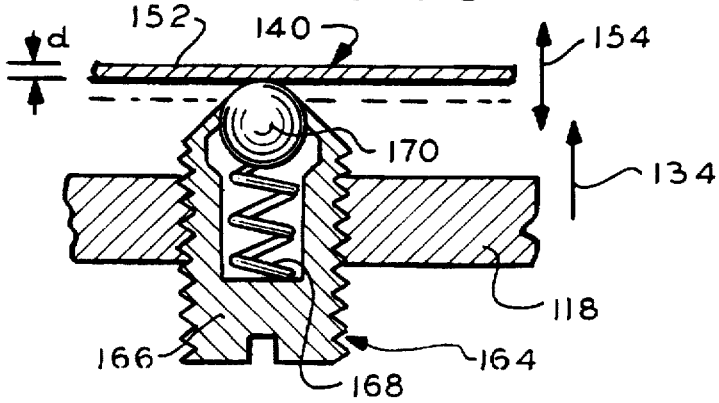

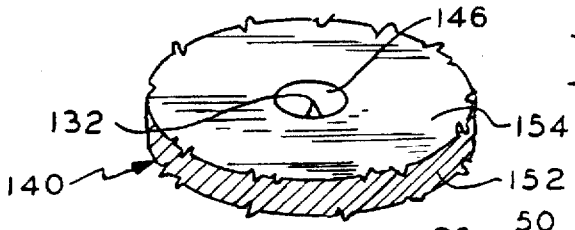
FIG. 6
FIG. 7
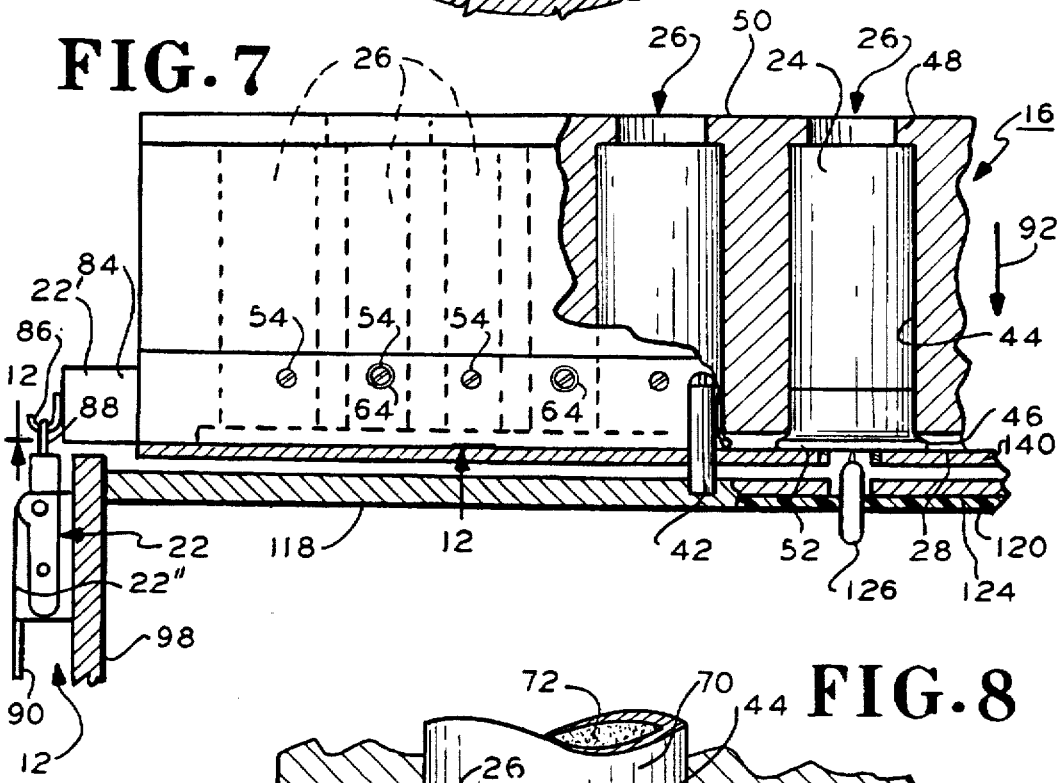
FIG. 8
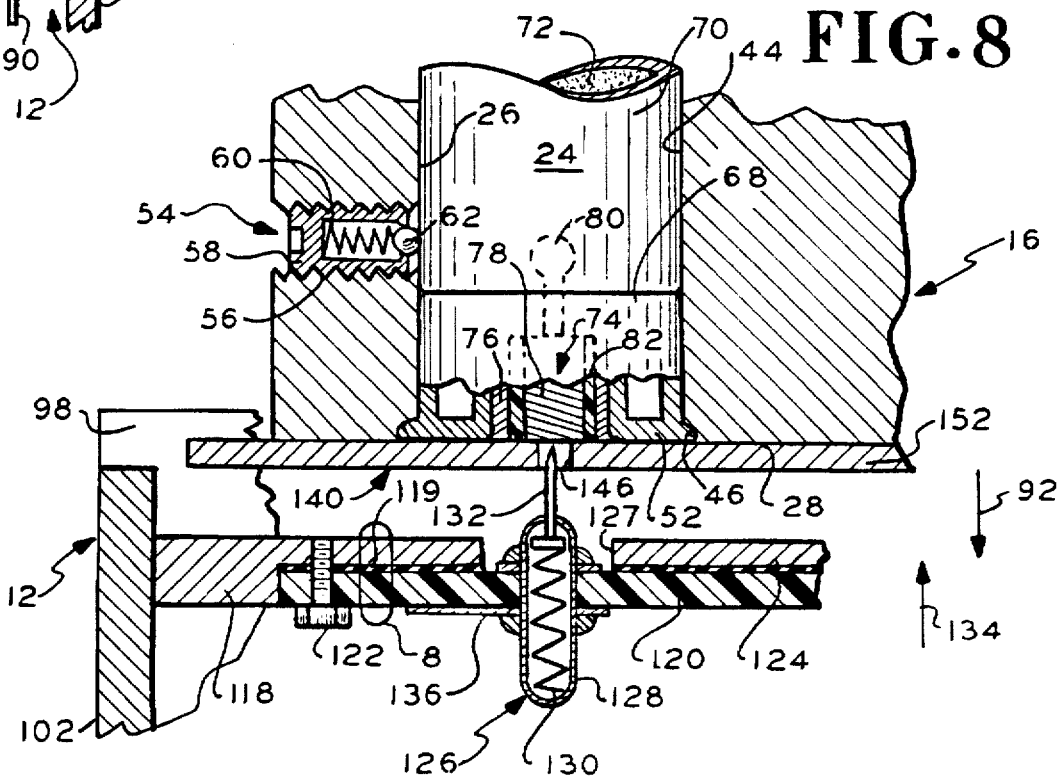

PYROTECHNIC IGNITION APPARATUS

This is a continuation of application Ser. No. 447,077 filed May 22, 1995, now U.S. Pat. No. 5,559,343 which is a continuation of application Ser. No. 145,499 filed Nov. 1, 1993, now U.S. Pat. No. 5,450,686 which is a division of application Ser. No. 877,809 filed May 4, 1992, now U.S. pat. 5,284,094 which is a division of application Ser. No. 419,549 filed Oct. 10, 1989 now U.S. Pat. No. 5,157,222.

This invention relates to an apparatus for receiving a plurality of pyrotechnic devices and for igniting such devices in a given sequence.

Of interest is copending application Ser. No. 383,650 filed Jul. 24, 1989 entitled Electrically Activated Detonator with Pyrotechnic Device Receiving Terminals and Method of Making in the name of Joseph L. La Mura et al. and assigned to the assignee of the present invention now U.S. Pat. No. 4,951,570.

Pyrotechnic devices are useful in many different applications. In one particular application, the military employs pyrotechnic devices for training of troops to simulate the receipt of a "hit" at a target. Training in the military is focused on offense and defense. In both instances there is a need for an apparatus that can simulate the firing of large caliber rounds, e.g. 105 mm, mounted on armor vehicles. The following are examples of training exercise modes. In one mode, armor vehicles are pitted against armor vehicles both vehicles moving, utilizing laser beam technology. Hit detectors are placed on the opposed vehicles. A gunner fires a large caliber weapon at the opposing vehicle emitting a laser beam which does not have any audio-visual effects. A pyrotechnic ignition apparatus (PIA) is mounted on the armor vehicle turret and is electrically connected to the gunner's trigger mechanism. Upon firing the simulated large caliber round, the gunner activates his laser to fire a beam of light and at the same time his action ignites a round (a pyrotechnic device), which provides the audio-visual effects of firing a large caliber round. Both the offense and defense troops can visually observe when they have been fired upon.

In a second mode, armor tank pitted against armor tank, the offense moves onto stationary defense. During this mode, the offense is moving through a prescribed tank course where simulated tank targets are activated and come into the view of the offense. At the same time that the tank target is activated, a device is ignited which simulates the defense (tank) fire power audio-visual effects as viewed by the offense. Throughout the offensive course, all hits scored on the defensive tank targets are registered on a computer network. A PIA device is ignited with each hit, setting off sound, smoke and flash at the defensive tank target site. The PIA has an interconnecting cable from the tank target. The tank target registers hits from the opposing forces via a tuned crystal which is attached to the tank target. When the tank target is hit by a fired tank round the resonate frequency of the crystal is activated transmitting an electrical pulse to the PIA via the interconnecting cable which in turn activates the PIA to ignite an audio-visual pyrotechnic device for the offense indicating that he has destroyed the defense tank.

In a third mode, armor tank versus armor tank, the offense is moving, the defense is stationary. The offense are tank target mechanisms which are placed at 100 meter intervals extending to 5k meters on a specific tank range. Tank targets are activated by remote control starting at 5k meters from the stationary defense. Each time a tank target is activated, a pyrotechnic device is ignited to simulate the tank gunfire of the simulated approaching tanks.

When the offensive simulated tanks come into the range of fire of the defensive tanks, the defense then fires their weapons at any selected ones of the targets that come into their sights. The defensive force fire live ammunition at the tank targets and the tank targets have the capacity of scoring each received "hit" round via a crystal detector. This information is transmitted via a computer network. At the time that the tank target receives a "hit", a pulse is generated that automatically ignites a PIA device which provides an audio-visual (flash and smoke) indication that the target has been hit. The pulse is transmitted via an interconnecting cable as a radio signal. These systems need a PIA which can ignite devices in large numbers repetitively and reliably.

The pyrotechnic ignition apparatus (PIA) in one implementation designed by the assignee of the present invention and demonstrated to the U.S. government in a prototype may be an array of firecracker type devices comprising pyrotechnic material filled in an insert which fits in an array of six inch tubes mounted on a support. Each round of the pyrotechnic device is exploded in turn in a sequence.

An electrically activated match is in the material of each insert and has a pair of protruding wires which are manually connected to the firing circuit. The manual connection occasionally causes the devices to be connected in an incorrect sequence. Electrical power to explode the pyrotechnic devices is received remotely via a cable. Each of the pyrotechnic devices is ignited via a digital circuit. The system has memory via a digital counter for continuing the sequence if the sequence is temporarily interrupted. Also, the sequence can be restarted from the beginning by resetting the counters with a reset switch using an R-C network. This system has the problem in that in certain conditions, the system can not reset. The sequence used insures that each device is fired once and that the next received firing pulse fires the next unfired device in the sequence. The misfiring of the devices out of sequence due to miswiring is a serious drawback.

In addition, the circuit includes a detector which indicates a valid received device in the array is in condition for ignition. The detector tests whether or not a pyrotechnic device is ready and in condition for ignition. In these kinds of systems for military purposes it is typical to use a lock-out system for preventing the system from firing immediately after loading in the interest of safety since loading is done manually. The above simulation apparatus, however, is somewhat awkward to use because of the need for manual reconnection of each of the devices during reload.

Other pyrotechnic systems are known for generally firing pyrotechnic devices at target areas in response to fire command signals received by the target. Generally, these various systems suffer from the disadvantage of requiring cumbersome and awkward reloading of the pyrotechnic device arrays or the devices are too small to be observed at large distances. Generally, some of these systems employ mechanical detonating devices which tend to deteriorate or misoperate due to contamination, corrosion and temperature variations. For example, sand and dirt clog mechanical impact detonators. Other systems are relatively awkward to use and not generally realistic. See for example, U.S. Pat. No. 4,245,403 wherein each detonater is wired to a circuit panel and a separate gas system generates the noise.

The present inventors desire to provide a remotely operated pyrotechnic devices which can simulate a hit or firing of rounds from different kinds of weapons. Because of the distance at which the target is placed from the firing weapon in different training modes, it would normally be difficult or impossible for the firing weapon operator to visibly observe the presence of personnel in some of the target areas. Therefore, it is incumbent to insure for safety purposes that the target area pyrotechnic devices cannot be set off upon receipt of an ignition command signal while personnel are in the target area, e.g. loading devices in the PIA.

The present inventors recognize a need for a pyrotechnic ignition apparatus for use with a radio operated system which has long life, is capable of operating safely with personnel nearby in the presence of premature emitted firing signals and for utilizing a minimum amount of electrical power for remote battery operation. The present inventors also recognize a need for a pyrotechnic apparatus which is capable of quick and simple reload while permitting such reloads to take place with relative safety. A problem with prior pyrotechnic apparatus is that, normally, when they include a plurality of pyrotechnic devices, not all such devices may be fired in a given time period. An array of pyrotechnic devices in a apparatus may include, for example, 20 pyrotechnic devices, only 10 of which are fired in a given period. In the next period, after the system has been set off, it may be desired to reload the 10 fired devices or continue firing the remaining 10 unfired devices or fire a selected portion of the remaining 10 unfired devices. Present systems however do not have the capability of handling such variables. In addition, the present inventors recognize a need for a pyrotechnic apparatus which can simulate the firing of different size rounds, for example 20 millimeter, 40 millimeter, and so on with one pyrotechnic apparatus.

A pyrotechnic device ignition apparatus for igniting a plurality of pyrotechnic devices received in a magazine in accordance with the present invention comprises a housing arranged to receive the magazine. A plurality of spaced electrical contacts engage the received devices. Securing means secure the contacts to the housing. A plate member is secured to the housing in overlying relation to the securing means and has at least one aperture therethrough through which the contacts protrude for engaging the received devices. Circuit means coupled to the housing apply at least one device ignition signal to the contacts. A gasket is between the securing means and the overlying plate member.

In a further embodiment, the gasket is arranged to seal the securing means to the plate member.

In a further embodiment, the securing means comprises a printed circuit board, the contacts each comprising a body and contact tip member secured to the body, the body being secured to the circuit board, the gasket for sealing the circuit board to the plate member at at least said at least one aperture.

IN THE DRAWING

FIG. 1*a* is an isometric view of a pyrotechnic apparatus in accordance with one embodiment of the present invention;

FIG. 1*b* is an isometric view of one of the magazines of the apparatus of FIG. 1*a* illustrating the loading of pyrotechnic devices into the magazine, the magazine being inverted from the orientation of FIG. 1*a;*

FIG. 1*c* is an isometric exploded view illustrating the assembly of the magazine of FIG. 1*b* to the control firing mechanism and support structure;

FIG. 5 is a plan view of the embodiment of FIG. 2 without the magazines in place;

FIG. 6 is an isometric view of a portion of the embodiment of FIG. 5 taken in the encircled region labeled with reference numeral 6;

FIG. 7 is a sectional elevation view of the embodiment of FIG. 2 taken along lines 7—7;

FIG. 8 is a sectional elevation view of the embodiment of FIG. 2 taken along lines 8—8;

Figure 1A:
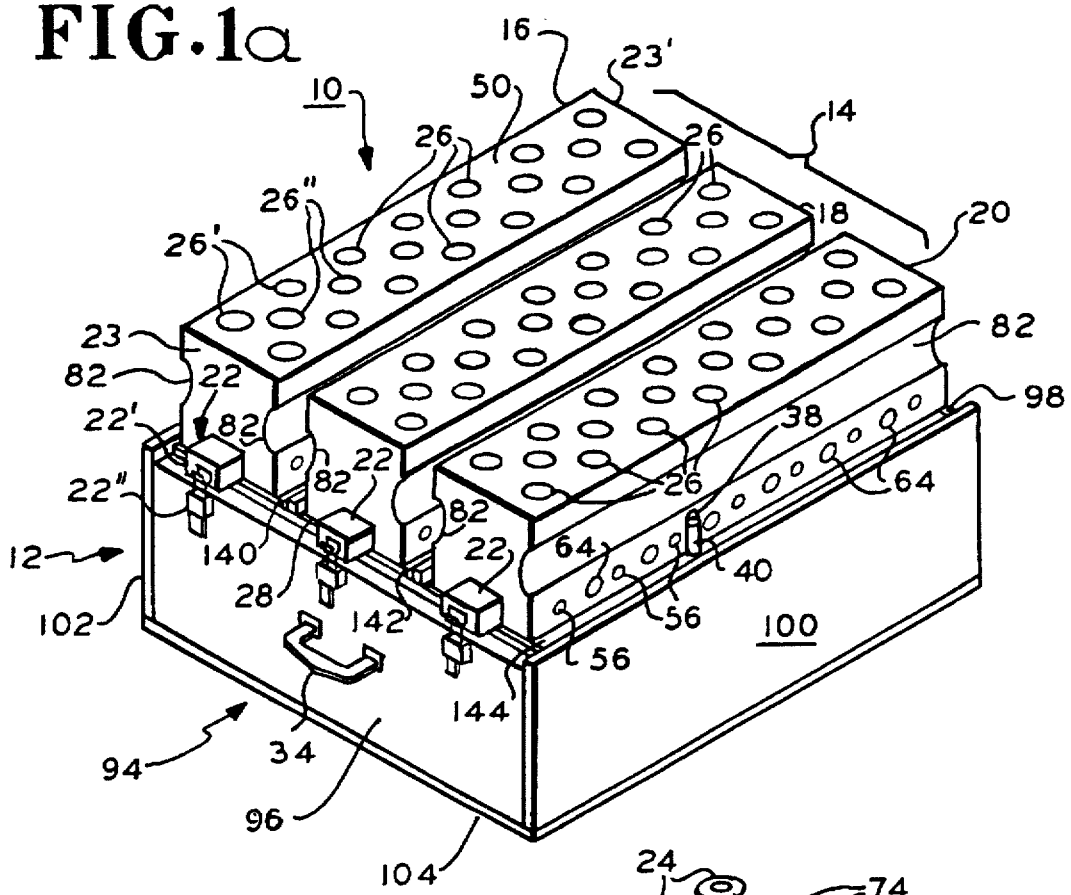
Figure 1B:
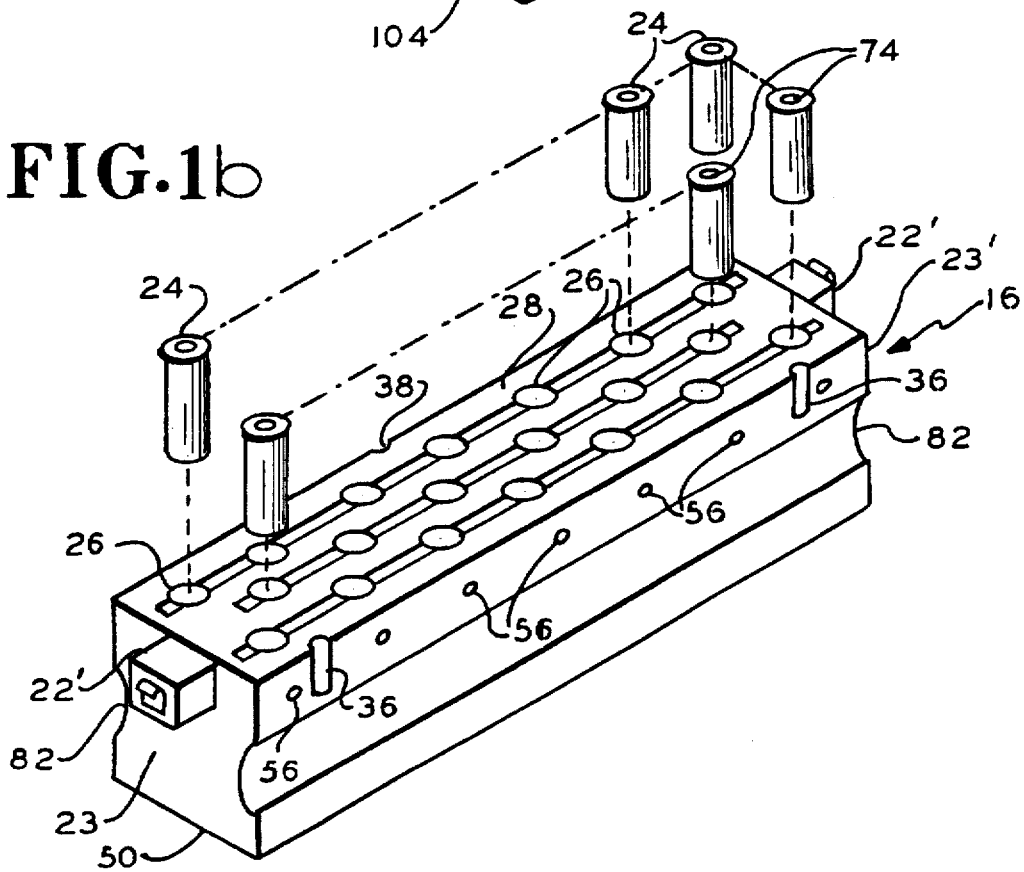
Figure 4:
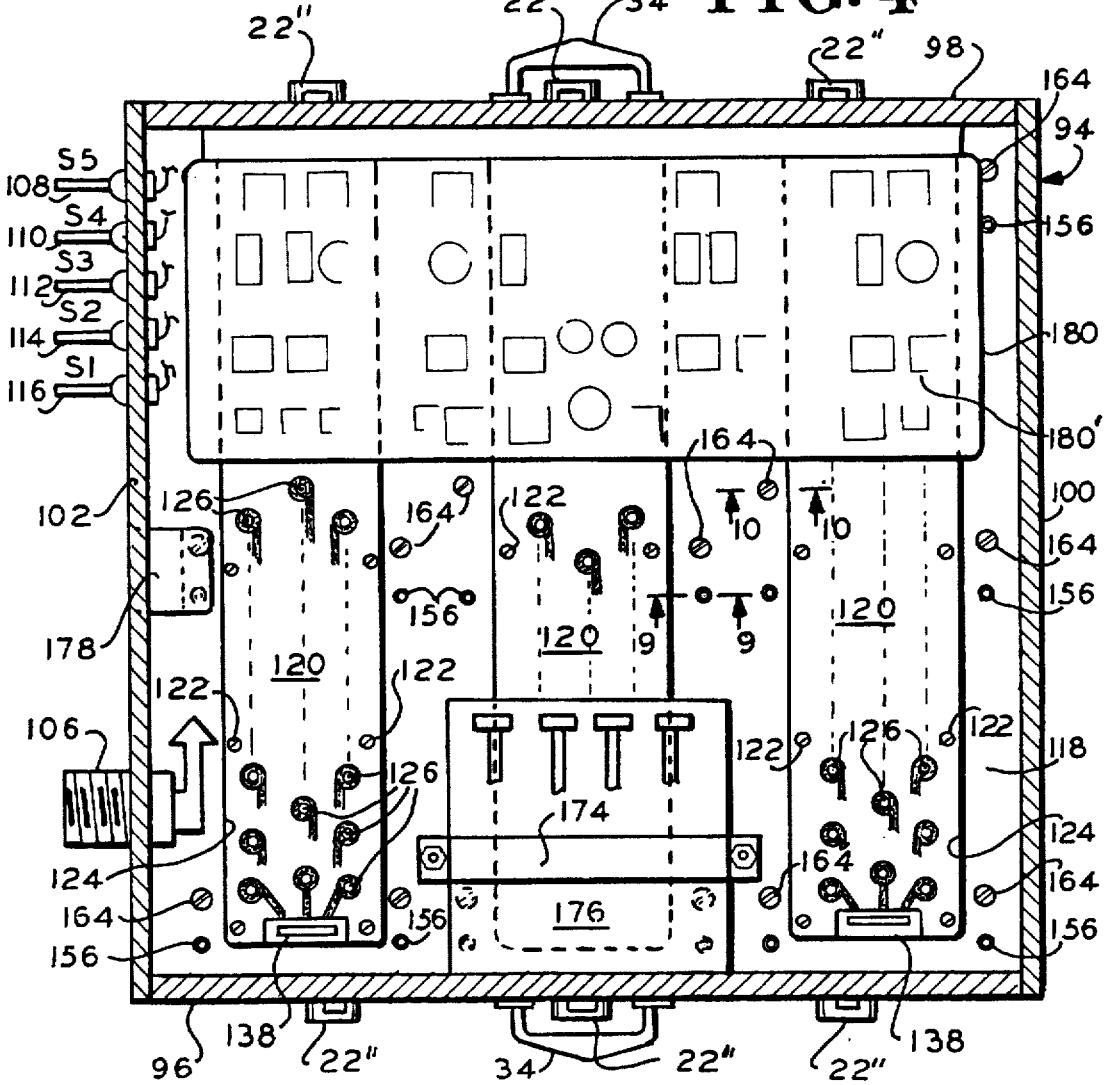
FIG. 4 is a sectional plan view of the embodiment of FIG. 3 taken along lines 4—4.
Figure 11:
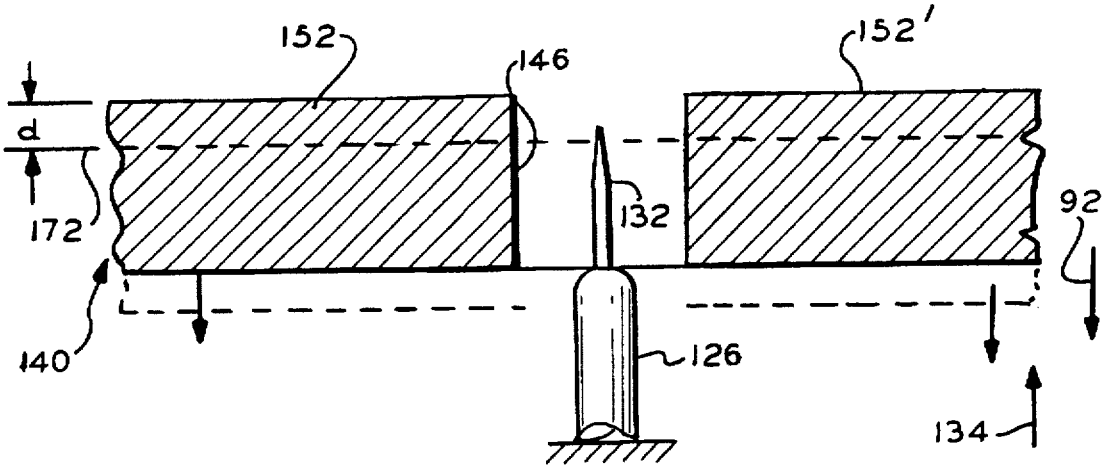
Figure 12:
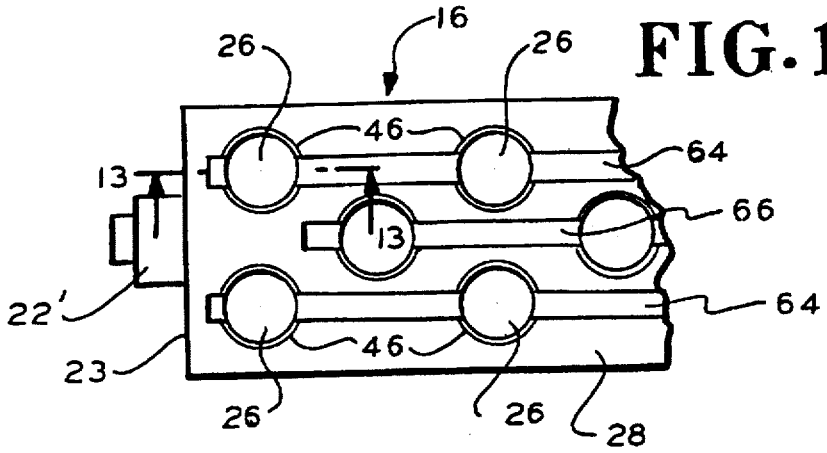
Figure 13:
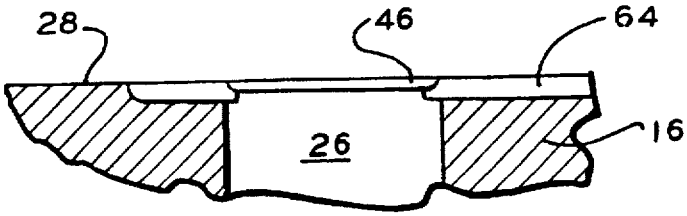
Figure 14A:
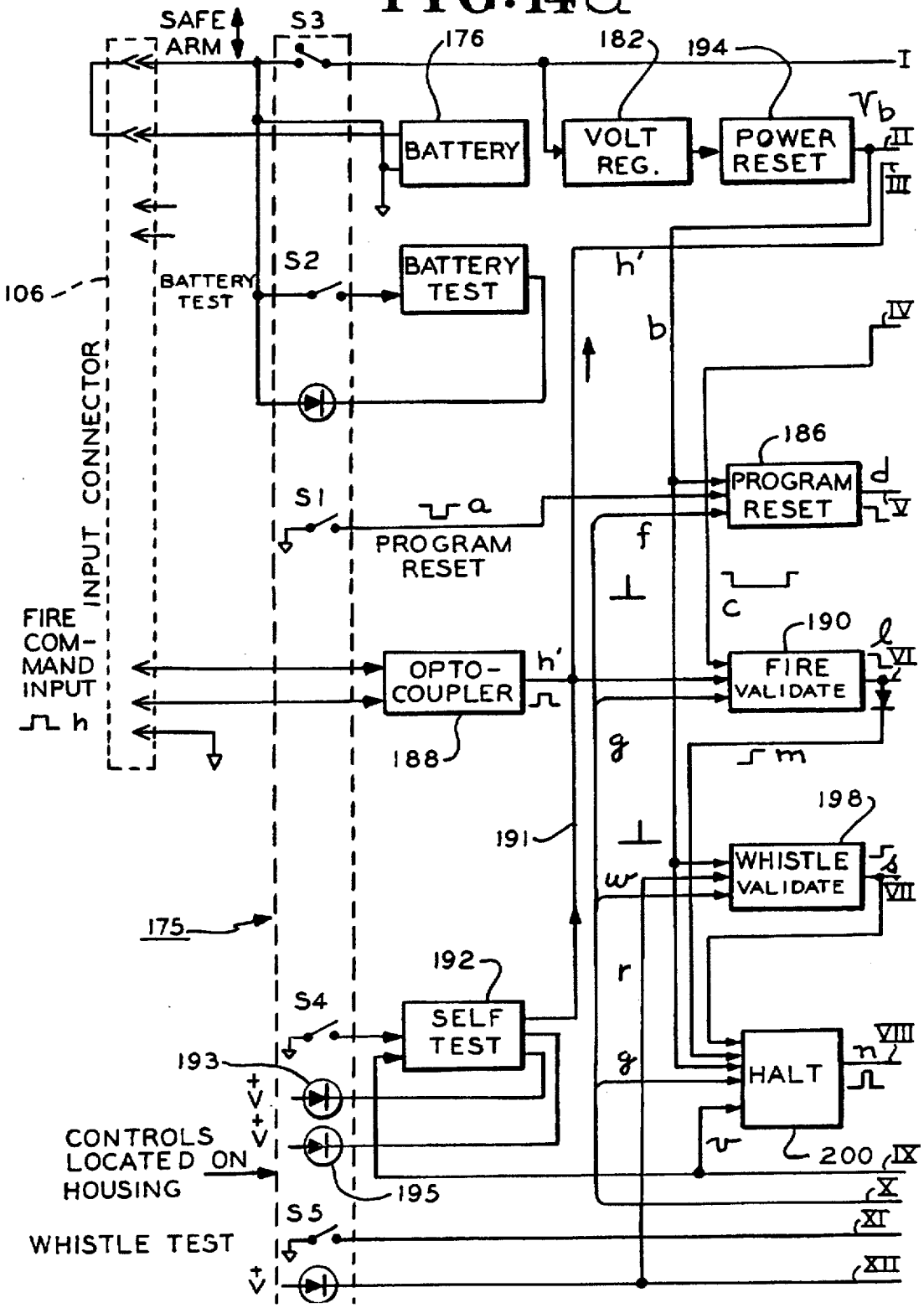
Figure 14B:
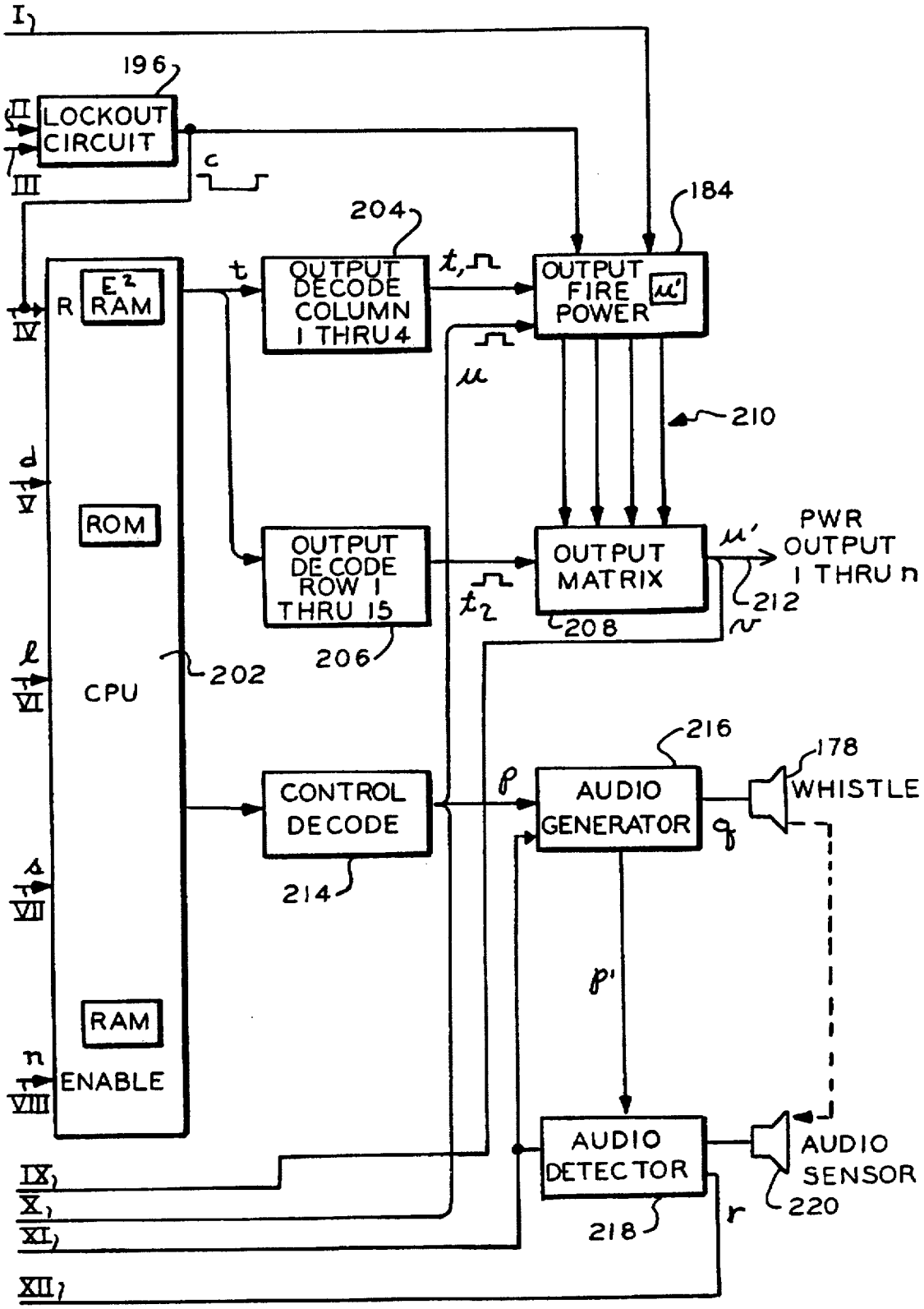

FIG. 8*a* is a more detailed view of FIG. 8 taken at region 8;

FIG. 9 is a sectional elevation view taken along lines 9—9 of FIG. 4;

FIG. 10 is a sectional elevation view taken along lines 10—10 of FIG. 4;

FIG. 11 is a sectional elevation view in enlarged detail taken along lines 11—11 in the embodiment of FIG. 5;

FIG. 12 is a plan view of a magazine in accordance with the embodiment of FIG. 1*b* showing the underside loading region of the magazine taken along lines 12—12 of FIG. 7;

FIG. 13 is a sectional elevation view taken along lines 13—13 of FIG. 12;

FIGS. 14*a* and 14*b* are respectively left and right portions of a schematic diagram of a circuit in accordance with one embodiment of the present invention for operating the apparatus of FIG. 1*a;*

Figure 15A:
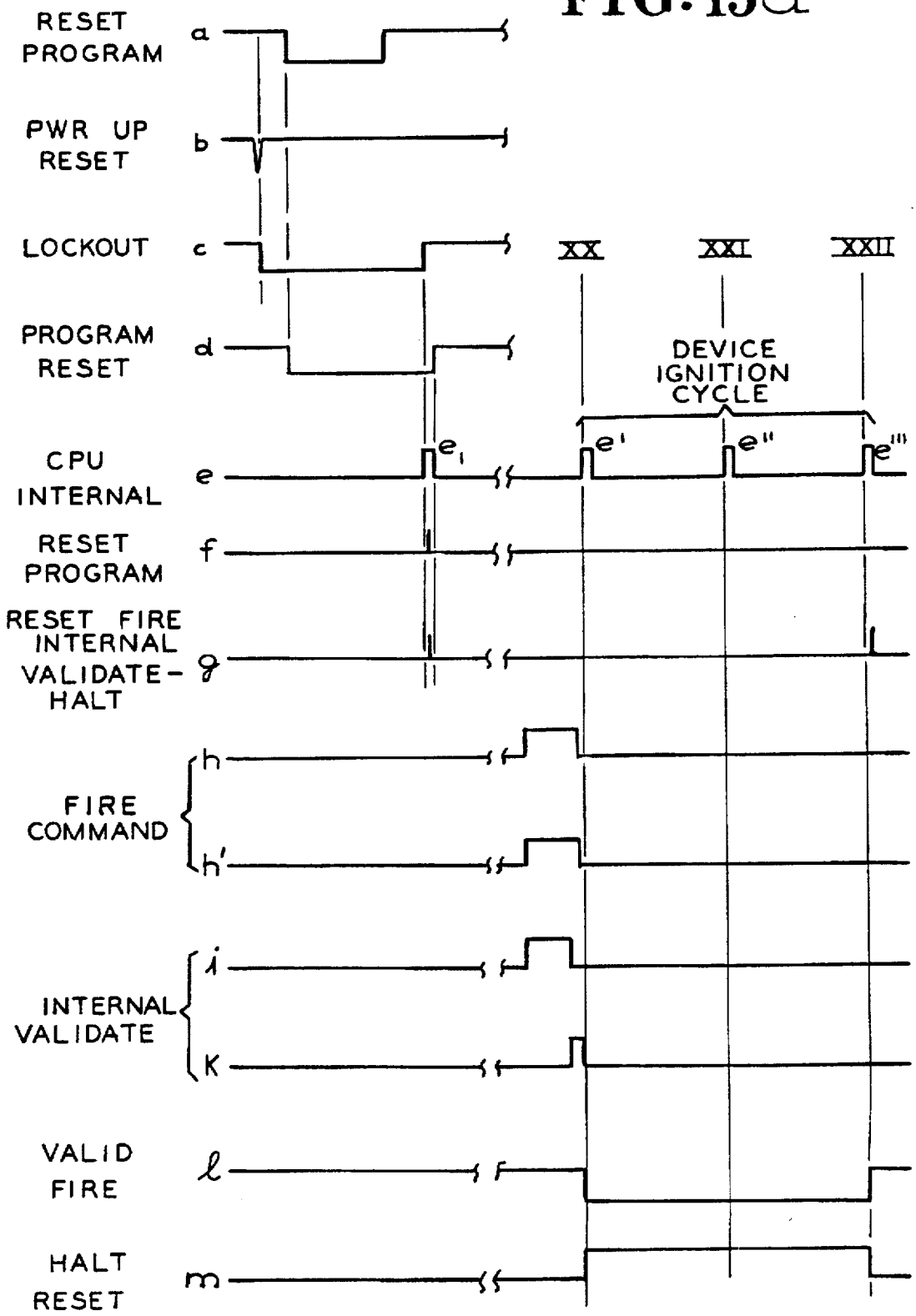
Figure 15B:
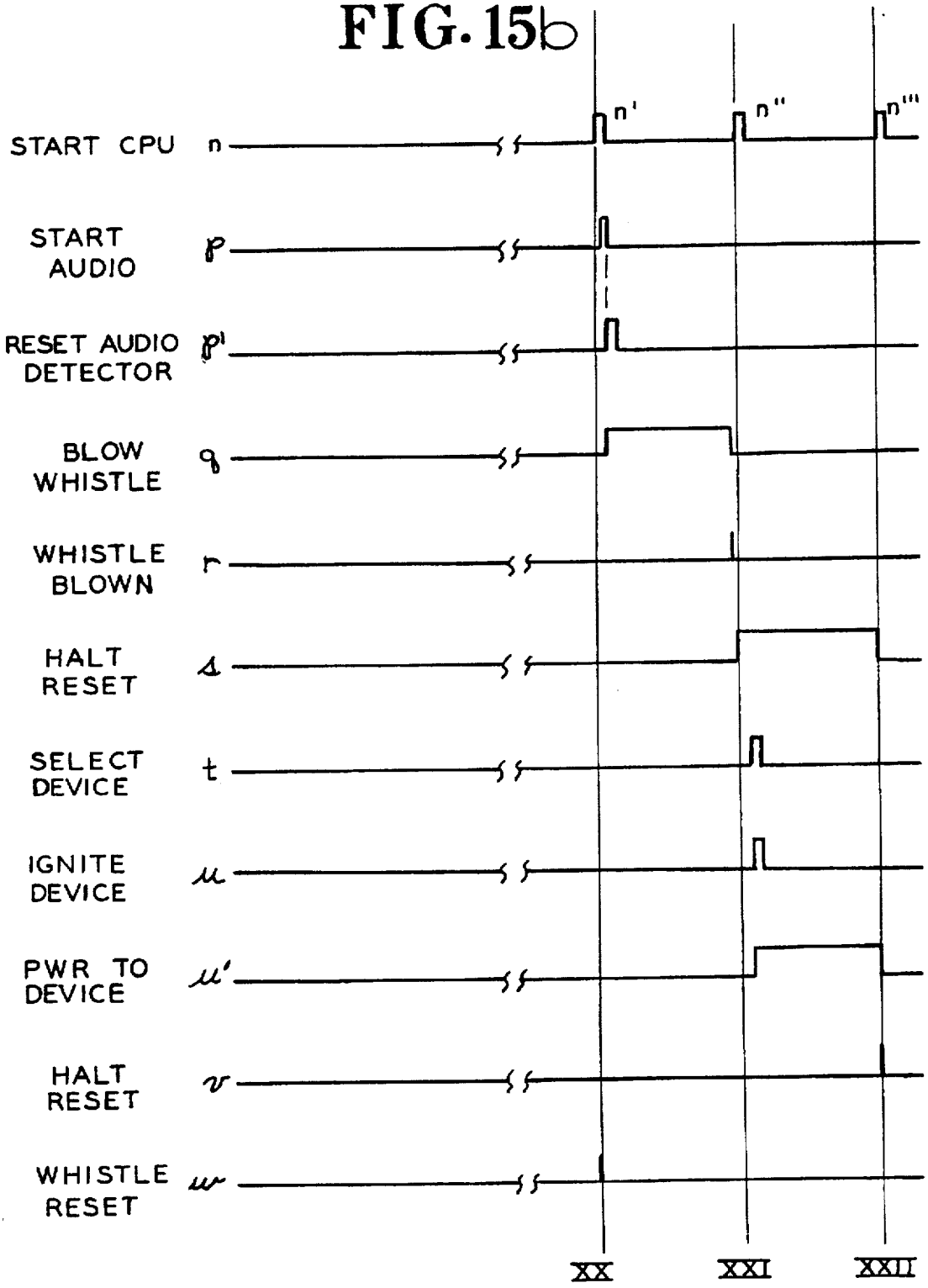
Figure 16:
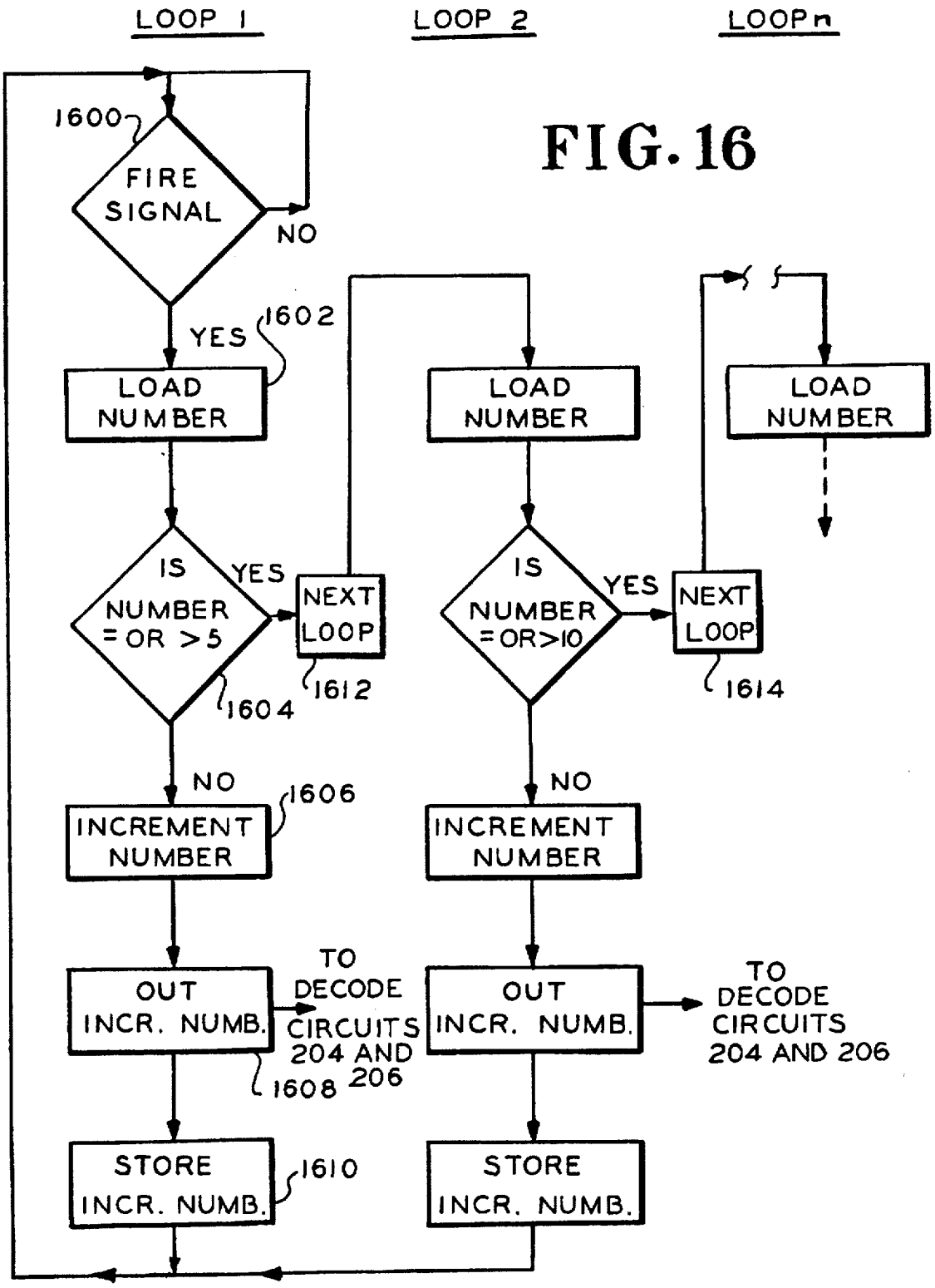

FIG. 15*a* and 15*b* are respectively upper and lower portions of a waveform diagram illustrating the timing relationship of different signals generated in the circuit of FIGS. 14*a* and 14*b*; and FIG. 16 is a flowchart diagram illustrating a portion of the computer programming sequence of the embodiment of FIG. 14.

THE MAGAZINES

In FIG. 1*a*, pyrotechnic apparatus 10 includes a fire control box and support assembly 12 and, secured thereto, is an array 14 of pyrotechnic magazines 16, 18 and 20. Each magazine for example, magazine 16, is secured to the support assembly 12 at each end by a latch assembly 22. The latch assembly comprises a hook assembly 22' attached to the end of magazine 16 and a loop assembly 22" attached to the support assembly 12. A latch assembly 22 is at each end 23 and 23' of magazine 16. Latch assemblies 22 are attached in similar fashion to each end of magazines 18 and 20 for releaseably securing each magazine of the array 14 to the support assembly 12. The latch assemblies 22 are all identical and all perform a similar function in not only securing a magazine to the support assembly 12, but in causing the received pyrotechnic devices mounted in each magazine to be electrically ohmically contacted to the circuit in the fire control box and support assembly 12.

Magazine 16, FIG. 1*b*, which is representative of the remaining magazines, which will not be discussed in further detail, includes an array of 20 receptacles 26 in this embodiment. The pyrotechnic devices 24 may be for example eight gauge shot gun shells of foreshortened length closely received in each mating receptacle 26. The devices 24 are inserted into the mating receptacles 26 via the bottom surface 28 of magazine 16. The magazine is then inverted from the position of FIG. 1*a* to the orientation of FIG. 1*a* and latched to the support assembly 12 with the devices 24 locked in place as will be explained in more detail later.

In one embodiment, the magazines 16, 18 and 20 have pyrotechnic device receiving receptacles of the same diameter as shown in solid line in FIG. 1*a*. The different magazines may, in the alternative, have receptacles of different diameters for receiving different size pyrotechnic devices. For example, assume the eight gauge shot gun pyrotechnic devices 24 represent large caliber rounds, for example 105 millimeter, and it is desired that the apparatus also simulate smaller rounds. In this case, magazine 18 instead of having receptacles 26 of the same size receptacles as magazine 16, may have receptacles 30, shown in phantom in FIG. 1*c*, of smaller diameter than the receptacles 26 e.g., as small as about ⅜ inch diameter. A magazine may have receptacles of the same size or different sizes, and, in addition, different magazines may have the same or different size receptacles.

For purposes of interchangeability, the center-line of all receptacles of the different magazines are identically located on the respective magazine structures. Also, the receptacles of different diameters also lie on the center-lines of the receptacles 26. The array of receptacles 26 is such that the center-lines are in identical position in each of the magazines 16, 18 and 20. Further, the center-lines of receptacles of different diameters also are coaxial with the center-lines of certain of the receptacles 26 regardless of the different diameter sizes of the differently dimensioned receptacles. Each magazine 16, 18 and 20 has the same peripheral dimension, for example, about one foot in length, about four inches on a side and about three inches high. The receptacles 26, for eight gauge shells, are about one inch diameter on one and one half inch centers.

Figure 1C:
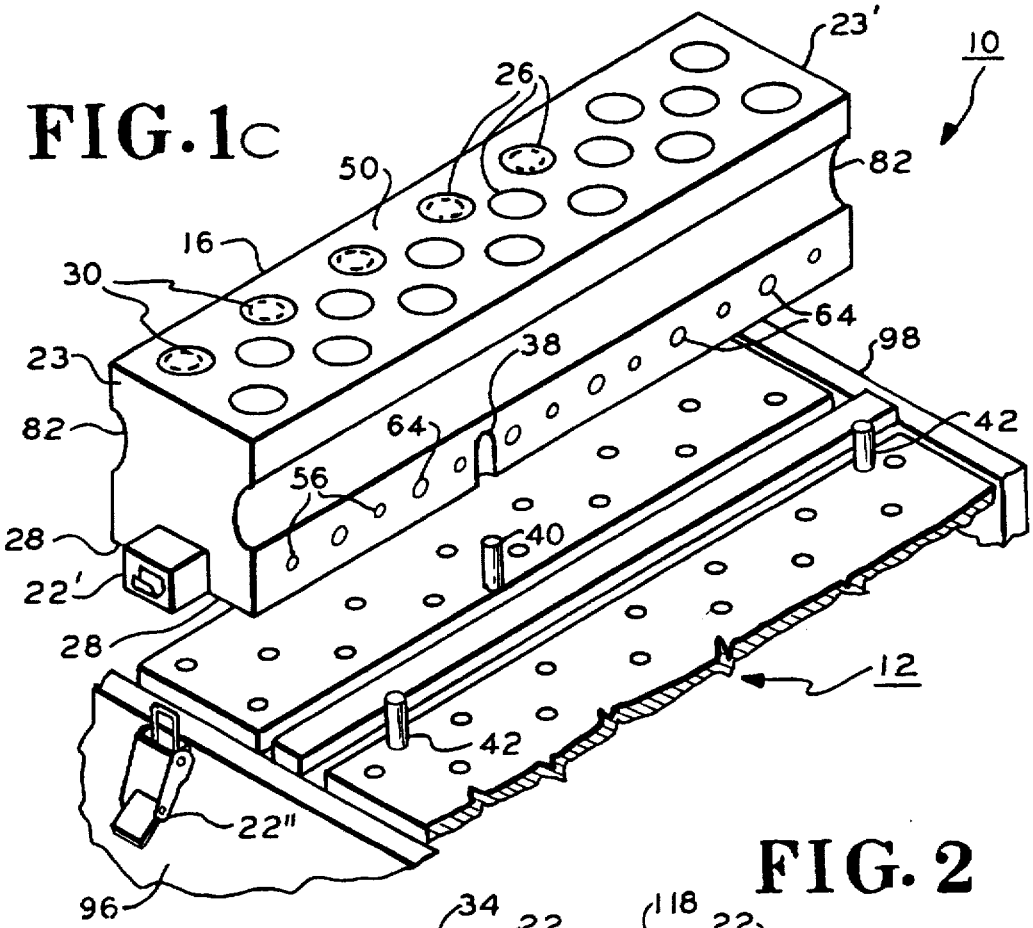

In FIG. 1*b*, magazine 16 includes a pair of guide slots 36 on one side thereof. A third guide slot 38 is on a side of magazine 16 opposite slots 36. Slot 38 mates with a guide pin 40, FIG. 1*c*, secured to the fire control box and support assembly 12. Guide slots 36 of magazine 16, not shown in FIG. 1*c*, mate with guide pins such as pins 42. Pins 42, FIG. 1*c*, are located in position to align slots corresponding to slots 36 of magazine 16 that are on magazine 18. The magazines 16, 18 and 20 and all other magazines which mate with the support assembly 12 have guide slots corresponding to guide slots 36 and 38 of magazine 16, FIG. 1*b*, for purposes of interchangeability. Guide pins such as guide pins 40 and 42, FIG. 1*c*, are positioned on the support assembly 12 in a location for receiving each magazine and guiding and aligning a magazine to the position of those guide pins.

In FIGS. 7 and 8, a typical receptacle 26 in representative magazine 16 includes a bore 44, a relatively larger shoulder 46 and an inwardly depending flange 48 at top surface 50. The device 24 is a circular cylinder such as a conventional eight gauge shotgun shell which is foreshortened so as to fit within the bore 44 of a length established by the inwardly depending flange 48. The reason for foreshortening the length of the shot gun shell is to prohibit use of commercially available eight gauge shells from being employed with the magazine 16. The device 24 terminates at it's activating end in an annular flange 52. The flange 52 is closely received in and recessed in the shoulder 46 of the receptacle 26 with the magazine 16 mounted against the support assembly 12. The flange 52 locks the pyrotechnic device 24 between the magazine and assembly 12. The device 24 abuts the flange 48.

A plurality of detent assemblies 54 are threaded into the side walls of the magazine 16, each detent assembly 54 for engaging a different pyrotechnic device 24 received in a corresponding receptacle 26. As best seen in FIG. 8, a typical detent assembly 54 is threaded in bore 56 which is in communication with bore 44 of receptacle 26. Detent assembly 54 comprises a threaded body 58, a compression spring 60 and a detent ball 62, the latter of which engages the tubular wall of device 24. There is a separate threaded aperture 56 and detent assembly 54 for each receptacle 26. A detent assembly corresponding to assembly 54 is employed to secure a corresponding pyrotechnic device regardless whether the magazine receptacles are the one inch diameter size, for example, of receptacle 26 or of smaller diameters of receptacles 30, FIG. 1*c*. In the present embodiment, each magazine 16, 18 and 20 is configured with an array of 20 receptacles 26 of like dimension. In this configuration, the array of receptacles, FIG. 1*a*, comprises outer receptacles 26' and inner receptacles 26". To secure a detent assembly 54 in communication with the inner receptacles 26", the aperture receiving the detent assembly 54 has countersunk holes 64 located in magazine 20.

In FIGS. 12 and 13, the bottom surface 28 includes a plurality of elongated recesses 64 and 66. The recesses 64 and 66 are in communication with all of the receptacles 26 and are deeper into the surface 28 then the shoulders 46. The recesses permit the manual grasping and removal of the devices 24 via flanges 52 which protrude into the recesses 64 and 66.

In FIG. 8, a typical pyrotechnic device 24 includes a metal casing 68 secured to a paperboard tube 70 which is filled with pyrotechnic material 72. A pyrotechnic detonater 74 includes an outer metal electrode 76 and an inner metal electrode 78, both electrodes being coupled to the electrodes of an electronic match 80. The electrodes 76 and 78 are insulated by a tubular insulation 82. The electrode 76 is in electric ohmic contact with the casing 88 of the pyrotechnic device 24. The casing 68 is in electrical ohmic contact with the magazine 16 which is also metal, preferably aluminum.

In FIG. 1*b*, after each magazine is loaded, the magazine is inverted with the detonaters 74 facing the fire control box and support assembly 12. In this orientation, the magazines are attached to the support assembly and latched thereto. Each magazine, FIGS. 1*a*, 1*b* and 1*c*, to be employed with the apparatus 10 of the present invention preferably includes finger gripping grooves 82 on opposing longitudinal size thereof to enable easy handling for manipulation of the magazine during loading and unloading of the pyrotechnic devices and to load and unload the magazines to the support assembly 12.

In FIG. 7, hook assembly 22' comprises a block 84 and a hook 86. The loop assembly 22" comprises a wire loop 88 attached to a rotatable handle 90 which is cammed to cause the magazine 16 to be forced toward the support assembly, direction 92. The latch assemblies 22 at each end of a given magazine, for example magazine 16, are latched to draw the magazine 16 against the support assembly 12. This will be discussed in more detail below.

FIRE CONTROL BOX AND SUPPORT ASSEMBLY

Figure 2:
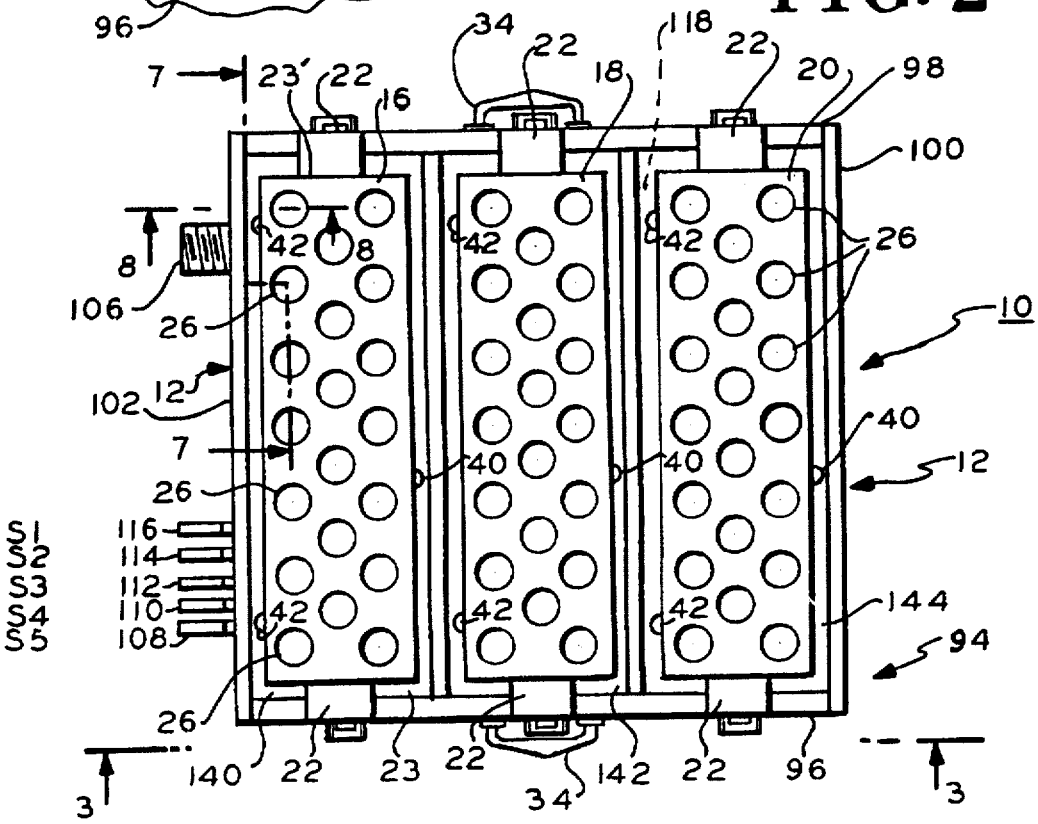
FIG. 2 is a plan view of the apparatus in accordance with the embodiment of FIG. 1*a;*
Figure 3:
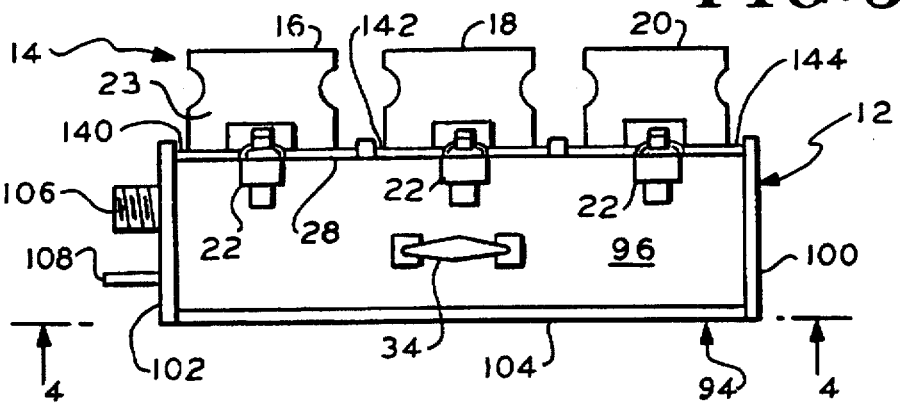
FIG. 3 is an end elevation view of the embodiment of FIG. 2 taken along lines 3—3.

Assembly 12, FIGS. 1*a*, 2 and 3 comprises a housing 94 which includes end walls 96 and 98, side walls 100 and 102 and bottom wall 104. Handles 34 are secured to walls 96 and 98 and a connector 106 for receiving fire command signals is mounted to wall 102 as are toggle switches 108, 110, 112, 114 and 116. Several of the switches, for example switches 114 and 116, may be spring loaded so as to return to an initial switch position when not manually engaged.

In FIG. 4, a support plate 118 is secured to the walls 98–102. A set of three identical printed circuit board assemblies 120 are secured to plate 118. Assemblies 120 are secured to plate 118 in recesses 124 by screws 122. Each assembly 120 includes an array of contact assemblies 126.

The array of contact assemblies 126 are set in the exact center-to-center spacing as are the receptacles 26 of the magazines, FIG. 2. Assume, for example, that the receptacles 26 are one inch diameter and spaced on 1½ inch centers. The contact assemblies 126, FIG. 4, are also set on the same 1½ inch centers. Thus, there is an array of 20 contact assemblies 126 per printed circuit board assembly 120 to mate with the 20 receptacles in a magazine.

In FIG. 8, a typical contact assembly 126 comprises a metal housing 128, somewhat tubular in shape, containing a compression spring 130 and a needle contact 132. The needle contact 132 is forced by spring 130 in direction 134. When the magazine 16 and the pyrotechnic devices 24 secured thereto are attached to assembly 12, the electrode 78 of the detonater 74 is in electric ohmic contact with the needle contact 132 which is resiliently compressed in direction 92. The needle contact 132 has a sharp point and because it is compressably forced against the electrode 78 by spring 130, it tends to dig into the electrode 78, which may be brass, making good ohmic electrical contact therewith. The contact assembly 126 housing 128 is soldered to a printed circuit board conductor 136 forming a hermetic seal over the opening in the circuit board assembly 120 through which the housing passes. A separate conductor 136 is soldered to each contact assembly 126 and terminates, FIG. 4, at electrical connector 138. Each circuit board conductor 136 is electrically isolated from each other conductor so as to provide a separate electrical pad for each of the individual contact assemblies 126. The circuit board assemblies 120 may also be hermetically sealed to plate 118 by a gasket 119, FIGS. 8 and 8*a*. The circuit board forming assembly 120 is made of electrical insulation electrically isolating each of the contact assemblies 126. The assemblies 126 pass through holes 127 in plate 118 to electrically isolate them from plate 118.

In FIG. 5, resiliently secured to plate 118 are three magazine support platform assemblies 140, 142 and 144. The assemblies 140, 142 and 144 are identical and the description of platform assembly 140 is representative. Assembly 140 includes an array of apertures 146 which are in identical center-to-center spacing as contact assemblies 126 and receptacles 26. In FIG. 6, apertures 146 are circular cylindrical openings formed in plate 152. Plate 152 is thinner than plate 118 wherein, for example, plate 152 may be 1/16 inch thick and plate 118 may be ½ inch thick aluminum. The apertures 146 are all aligned on and coaxial with the centers of the receptacles 26 of the received magazines 16, 18 and 20 and, therefore, with the centers of the contact assemblies 126. The needle contact 132 of each assembly 126 protrudes through the aperture 146 when it contacts a pyrotechnic device.

In FIG. 9, plate 152 displaces relative to and is guided during displacement in directions 154 by shoulder bolts 156. There are an array of six spaced shoulder bolts 156 adjacent to and corresponding to each platform assembly plate 152. There are three shoulder bolts 156 on each side of plate 152 of each of the platform assemblies 140, 142 and 144 (FIG. 4). A shoulder bolt 156 comprises a head 158, a guide shank 160 and a threaded stud 162 which is threaded to plate 152. The shank 160 engages a mating closely received bore in plate 118 such that the shank 160 slides in directions 154 relative to plate 118. Shank 160 is sealed to plate 118 by O-ring 161.

Adjacent to each of the shoulder bolts 156, FIG. 4, is a spring loaded plunger 164. A typical spring loaded plunger 164, FIG. 10, comprises a threaded body 166 containing a compression spring 168 and a detent ball 170. The body 166 is threaded to plate 118 such that the ball 170 resiliently forces plate 152 in direction 134 opposite direction 92, FIG. 7. The resiliently secured ball 170 permits the plate 152 to displace a distance sufficient for the needle contact 132, FIG. 11, to protrude through aperture 146. Normally, with the magazine not attached to the assembly, the contact 132 is recessed below the surface 152' of plate 152. The insert 154 is normally approximately flush with the tip of contact 132. After plate 152 is displaced in direction 92 by the latching of the magazine 16 to the platform assembly 140, the plate 152 is displaced an amount, distance d, sufficient for each contact 132 to protrude through the plate 152 and engage the electrode 78 of the detonater 74 (FIG. 8).

After plate 152 is displaced in direction 92 by the engagement of the magazine therewith, surface 152' (FIG. 11) is displaced to the plane of line 172 which is below the tip of contact 132. By way of example, the contact 132 tip may be 0.030 inches below surface 152' with the magazine loosely held by the latch 22 with the contacts 132 disengaged from the corresponding devices 24. After the magazine is fully displaced and the contacts engaged with the corresponding devices 24, FIG. 7, the contact tip may extend above surface 152' 0.030 inches for a total displacement of 0.060 inches of plate 152. Thus, the latches 22, FIG. 7, when fully engaged, not only lock the magazine 16 to the support assembly 12, also displace the magazine 16 and platform assembly 140 in direction 92 a distance sufficient for all contacts 132 of the contact assemblies 126 to simultaneously engage the respective electrodes of the pyrotechnic devices 24 that are mounted in a given magazine.

When the pyrotechnic devices 24 are ignited and spent, the magazines 16 and so on are released from the support assembly, the spent casings are removed manually and new pyrotechnic devices inserted in the receptacles and the magazines again attached to the support assembly so as to reload the apparatus.

In FIG. 4, secured to plate 118, via bracket 174, is a battery 176. Secured to wall 102 is an electronic whistle 178 e.g., a siren. A stack 180 of printed circuit board assemblies 180' are secured to housing 94. The stack 180 of printed circuit board assemblies 180' contains the circuit of FIG. 14 of the operating system.

THE ELECTRONIC SYSTEM

In the following description, FIGS. 14 and 15 are referred to. The circuit 175, FIG. 14, has the following capabilities.

1) The devices in all of the magazines are collectively ignited in a given predetermined overall sequence, or in selected different sub-groups in that sequence.

2) When power is first applied via switch S3, no pyrotechnic device can be ignited until a predetermined interval has passed, e.g., one minute. The switch S3 is manually operated and this interval permits personnel to leave the vicinity of the devices prior to ignition from a remotely sensed command signal.

3) After power is first applied, during that predetermined interval, an operator via switch S1, can selectively cause the system to restart an ignition sequence at the beginning of the sequence or, by not operating switch S1, the system will commence igniting devices after the last ignited device in the sequence when the system was last operated.

4) The circuit 175, when modified as described later, can selectively start an ignition sequence at any one of a number of different predetermined subset portions of the overall sequence based on the characteristics of a device ignition command signal unique to that subset portion.

5) The operating time of the system when it draws power for igniting a device and for resetting the various circuits is less then 200 microseconds as compared to an over cycle time of several seconds for igniting that device to minimize battery drain and emission of EMI signals by the system.

6) In one embodiment, a whistle gives an audible warning that a device is about to be ignited and the system will not ignite a device unless that warning is given.

Switches S1–S5 inclusive, FIG. 14, correspond to switches 108–116, FIG. 4. Switch S3 is coupled to the battery 176 for applying power to the circuit. The housing 94 serves as system ground. Power is supplied from the battery 176 to a voltage regulator 182. Regulator 182 supplies power to the output fire power circuit 184 via powerup circuit 194 and lockout circuit 196 and also to the remaining components of the circuit.

Power up reset circuit 194 generates pulse b from the rising edge of the applied power which is applied to lockout circuit 196 which generates signal c, a low, having a predetermined duration, e.g., one minute. Pulse b is applied also to the reset input of a set-reset (S-R) flip-flop program reset circuit 186, to set its output state signal d high, the reset input of S-R flip-flop whistle validate circuit 198 to set its output state signal s low and to the reset input of S-R flip-flop circuit 200 to set its output state signal n low. Signal b resets the latter circuits upon initial application of power by the closing of switch S3. Switch S2 closes the circuit to the battery 176 for testing the battery. Switch S1 coupled to ground when closed, provides a program reset signal, a low pulse signal a, FIG. 15, to the set input of circuit 186, setting signal d low. A fire command input signal h is remotely generated by an external source (not shown) upon receipt of a signal and applied to the circuit via connector 106. Signal h is applied to an optical coupling circuit, opto-coupler 188, which optically couples input fire command signal signal h, to the remainder of the circuit electrically isolating the circuit from the external circuit connected to connector 106. The opto-coupler 188 in response to the received input signal h generates output signal h' which is applied to fire validate circuit 190 and to lockout circuit 196 for fire command one minute pulse signal c of if a fire command is received during the pulse of signal c.

Switch S4 is coupled to a reference potential, e.g. system ground, to enable self-test circuit 192 comprising an oscillator and two counters, to test the circuit for proper operation via line 191. The ground level signal on line 191 disables opto-coupler 188 and causes the circuit 190 to generate a pulse train, a series of pulses signal 1. Switch S5 applies a reference potential signal, e.g., ground, for testing the audio whistle portion of the circuit 175. The whistle validate and halt circuits 198 and 200, respectively, generate signals s and n which cause the CPU 202 to operate in operating periods represented by pulses e', e" and e'" after signals b and c are generated.

Signal c is applied to the reset input of the central processing unit CPU 202 disabling the CPU and to the fire validate circuit 190. Signal c is referred to as a lockout signal because it precludes a valid fire command signal h' from enabling the validate circuit 190 and disables the CPU to preclude firing a pyrotechnic device. Signal c is applied to an AND gate (not shown) in circuit 190 disabling the validate circuit 190, i.e., signal 1 remains high, even in the presence of a valid command signal h'.

Signal c serves another function; if the CPU reset input R receives a low signal c at the time switch S1 is closed, which generates signal a, the program reset circuit 186 is set and generates signal d, a low. If signal d is low at the time c is low, the internal instructions of the CPU 202 sense these values and the CPU operates during the time of an internally computer programmed interval of pulse $e_1$ at the trailing edge of pulse c. The CPU operates and reloads an internal $E^2$ RAM with the address of the first device of the firing sequence, device number one during pulse $e_1$. The CPU during this operating period, which is started by the values of the R input, signal c, and the value of signal d, causes signals f and g to be generated which then reset circuits 186 and 190, respectively. The resetting of circuit 188 sets signal d high. The resetting of circuit 190 sets signal 1 high, if not already high, to await a valid fire command signal h'. If d is high at the time of signal $e_1$, the computer program in the ROM jumps the $E^2$ RAM reset instructions and no reset of the $E^2$ RAM occurs. The $E^2$ RAM contains the address of the last ignited device and continues igniting devices with the next device in the given sequence upon receipt of the next fire command signal h'. The CPU operating pulse $e_1$ only occurs when power is first turned on. As long as the system remains powered, the system thereafter in response to a fire command signal h' cycles through an ignition cycle for igniting one device comprising the time periods of pulses e', e" and e"' Subsequent ignition cycles for sequentially igniting the remaining devices occurs upon receipt of each subsequent valid fire command signal h'.

The fire valid circuit 190 comprises two internal timers in addition to the AND gate mentioned above and a D flip-flop clocked by the AND gate output, inverted. The timers internally generate signals i and k, FIG. 15. Signal i is 20 milliseconds long and signal k is 10 milliseconds long, for example. Signal k is applied to the D input of the flip-flop. The output Q of the flip-flop is signal m and the $\overline{Q}$ output is signal 1. The diode at the output of circuit 190 passes the inverted m signal to circuit 200. The fire command signal applied to the opto-coupler 188 produces fire command signal h' which is 25 milliseconds long by way of example. Circuit 190 tests signal h' for duration and voltage amplitude. In the description herein the various pulse lengths are given by way of example for purpose of illustration. Also, it should be understood that single wires represent multiple wires or busses.

The two timing signals i and k of the fire validate circuit 190 have a combined length of 30 milliseconds to allow for a tolerance of ±5 milliseconds for the signal h'. The fire validate circuit 190 indicates the signal h' is valid when the trailing edge of the h' signal is in the range of the 10 millisecond duration of signal k. If that occurs then the fire validate circuit 190 flip-flop generates a low output signal 1 at it's Q output and applies that signal to CPU 202. CPU 202, for example, may be a microprocessor 8720 manufactured by National Semiconductor Corporation.

The CPU 202 contains an electronically eraseable RAM ($E^2$ RAM), a separate RAM, programmed instructions for operating the CPU during signal $e_1$ and ROM. A computer program is stored in the ROM and instructs the CPU through the operating sequence during each signal e pulse interval. The program tests the values of signals d, l, s, and n during different e signal pulses for operating the CPU and for generating appropriate data at the CPU output ports. The program reset circuit 186 signal d is sensed by the computer program stored in the ROM to selectively change the address of the first device ignited in an ignition cycle to the beginning of a sequence or at the point where a previous ignition sequence terminated should not all of the pyrotechnic devices in the stored magazines be ignited. For example, assume each of the three magazines holds twenty pyrotechnic devices or sixty devices in all. An ignition sequence ignites the sixty devices in a given order one at a time. A signal h' causes one device to be ignited. In response to each received fire command signal h', a separate device is ignited sequentially one at a time.

Should a portion of the devices be ignited from the beginning of the sequence e.g., devices 1–27 but the entire sequence not completed by turning the system off, the $E^2$ RAM remembers the address of the last device, e.g., number 27 in the sequence, that was ignited. When the system is next turned on, the location of the next to be ignited device in the sequence, number 28, is remembered by the $E^2$ RAM unless reprogrammed to start at the beginning if switch S1 is closed within 60 seconds after switch S3 is closed, when c is low. The CPU is programmed to then generate an ignition timing signal u for that next pyrotechnic device in the desired sequence upon receipt of the next fire command signal h'.

The CPU 202, except after initial power turn on when it is programmed to be internally enabled during pulse $e_1$, is enabled by signal n from the halt circuit 200. The enabling of the CPU is an internal sequence in the 8720 circuit. In the periods between the pulses of signals e, the CPU is disabled and off. Each instruction of the computer program in the ROM has a given time duration.

The CPU steps through a given number of instruction steps in the program to establish the operating time duration of the CPU, e.g. the duration of pulses $e_1$, e', e" and e'". The CPU has an internal clock, for example, 10 mhz, which tends to emit electromagnetic interference (EMI). Also, the CPU, being battery driven, acts as a drain on the battery when operating. Therefore, it is desirable to operate the CPU in as short intervals as possible and maintain it in the idle mode for as long as possible to avoid generation of EMI and draining the battery. This is so the system can be remotely operated for large periods of time and won't interfere with the emitted radio signals from the "hit" sensing nearby radio receivers. For this reason, a typical CPU operating time interval, pulse $e_1$ for example, is about 66 microseconds. The various commands and tasks issued by the CPU occur within these time intervals. The time period of pulses e' to and including pulse e'" is one device ignition cycle which generally is about 2 seconds.

Each contact assembly 126 in the assembly 12 is assigned a unique row and column address. The circuit 175 includes two commercially available decode circuits 204 and 206 which respectively decode column locations and row locations for each of the contact locations corresponding to each of the three received magazines receptacles 26. The circuit divides the 60 contact assembly locations into four columns and fifteen rows. The decode circuit 204 is a standard 4 to 10 decode integrated circuit which decodes the column position, columns 1 through 4, into a column relay address signal $t_1$, via the higher four bits of an eight bit signal t generated by the CPU. The decode circuit 206 is a standard 4 to 16 decode integrated circuit which decodes the row information, the lower four bits of CPU generated signal t into a row address signal $t_2$, rows 1 through 15.

Each pyrotechnic device receptacle location of the three magazines has a given address located in a given column and given row. Signal $t_1$ is four different signals on four different respective lines. Signal $t_1$ addresses one of four relays (not shown) in circuit 184 in combination with signal u via four different AND gates (not shown). Each of four selected output lines 210 is coupled to a source of power according to that AND gate which is enabled. Signal $t_2$ is applied to output matrix circuit 208 for addressing and closing one of 15 row switches (e.g. transistors) The output fire power circuit relays (not shown) apply a power signal from switch S3 to the output matrix circuit 208. The circuit 214, a 4–10 decode device (four lines in, ten lines out), receives a program created binary encoded signal from the CPU and decodes this signal to produce signal u. The matrix circuit 208 output signal u' on line 212, for example, one amp, is received from one of lines 210 and ignites a particular device in one of the magazines in the given sequence as addressed by the enabled relay of circuit 184 and switch (not shown) of matrix circuit 208. The time duration of signal u' is set by a timer (not shown) in circuit 184, e.g., 100 ms. Signal v is a pulse generated at the trailing edge of signal u' by circuit 184.

Control decode circuit 214 is a standard four to ten decode chip which generates signals in response to commands from the CPU. Circuit 214 generates signal u which is applied to the output fire power circuit, signal f which is applied to reset the program reset circuit 186, signal g which is applied to reset the validate circuit 190 to set signal l high and signal w which is applied to the reset input of whistle validate circuit 198 to set signal s low. Signals f and g are generated after power turn on, during pulse $e_1$. Signal g is also applied to circuit 190 at the end of each ignition cycle in period e'".

The control decode circuit 214 also generates a signal p starting audio generator circuit 216 upon command from the CPU. This is to sound an alarm whistle produced by whistle 178 prior to ignition of a device. The audio circuit 216 is also started by closing switch S5 coupled to a power source. The audio generator circuit 216 generates a signal p' which resets audio detector 218. Audio detector 218 includes an audio sensor 220 which senses the sound of the output whistle generated by the audio generator whistle 178. The audio signal sensed by the audio sensor of the audio detector 218 generates a pulse signal r at the end of a counted time period, e.g. 2 seconds, using a digital counter to measure the time duration of the whistle. The signal r at the end of the whistle period is generated and applied to the whistle validate circuit 198. Signal r sets circuit 198, i.e., signal s goes high.

The fire validate circuit 190 when enabled by the signal h' generates signal l. Inverted signal l forms signal m which is applied to the set input of halt circuit 200. In response to m going high, the halt circuit 200 generates signal n' which enables the CPU, pulse e'.

Signal h' when applied to lockout circuit 196 restarts the generation of lockout pulse signal c. Signal c when low, it will be recalled, disables the CPU for one minute after the power is turned on. However, if signal h' is received in that one minute interval, circuit 196 will restart the one minute clock.

The CPU ROM program during the time of pulse $e_1$ checks the value of the program reset signal d and sets the output port configurations. If the input signal to the R input of the CPU is low, the CPU will not operate. If the signal d is low, the CPU during period $e_1$ will load the $E^2$ RAM with the address of that receptacle which is first in the firing sequence for the devices contained in the three magazines. If the program reset signal d is high, the CPU will not change the receptacle address location presently in memory. Only the occurrence of signal a during the one minute interval of signal c will cause signal d to go low. Each time signal d goes low to high the CPU reloads the $E^2$ RAM with the address of the first device to be ignited in the selected sequence. This action only occurs when the system is turned on. If signal a remains high in the initial time period of pulse c, signal d remains high and the CPU is instructed to jump the memory load instruction causing the $E^2$ RAM to address the device next to be ignited in the sequence.

The fire validate circuit 190 signal c input prohibits a fire command signal h' from starting the timers in circuit 190. If h' is high and signal c is low the circuit 190 is disabled. Signal h' is inverted to clock the 10 milliseconds timer of circuit 190. This latches signal m causing l to go low. Signal m goes high and causes the CPU to start pulse e' via halt circuit 200 signal n'. The CPU tests the fire validate signal l. If l is high, the fire command is invalid and the CPU returns to the start of the program. If l is low, this indicates a valid fire command and the programmed firing sequence continues. Signal g applied to the fire validate circuit resets the D flip-flop in the circuit 190 and causes signal m to go low and signal l high. This resets the fire validate circuit for the next valid h' fire command signal.

Signal b upon initial power up resets the output state of circuit 198 generating signal s, a low. Signal r sets the flip-flop of circuit 198 output state, signal s, high. Signal r is generated at the end of the whistle so that a high s signal indicates the whistle blew. A high s signal goes to the halt circuit 200 generating signal n" causing the CPU to operate during pulse e". Signal u causes signal u' to be generated, recall that the ignition signal u is generated during pulse e". Signal v is applied to the halt circuit 200 resetting it. This generates signal n"' which enables the CPU in the period of pulse e"'. After a device is ignited, the CPU ROM stored program causes signal w to be generated during pulse e"' which resets the circuit 198 signal s low. A whistle signal w is also generated by the CPU in the initial CPU operating period of an ignition cycle, during pulse e' to reset the circuit 198 signal s low at this time if it is not already low.

The following summarizes the CPU events.

A. During the period of pulse $e_1$, which starts at the trailing edge of the signal c pulse, the CPU:
   1. Configures the output ports.
   2. Tests program reset circuit 186 output signal d.
   3. Loads the program $E^2$RAM with a new address.
   4. Resets the program reset circuit 186, signal f.
   5. Resets the fire validate circuit 190, signal g.

B. During the period of pulse e', initiated by the rising leading edge of pulse m, the CPU:
   1. Tests the fire validate circuit 190 output signal l.
   2. Starts the whistle signal p from circuit 214.

C During the period of pulse e", initiated by the whistle blown pulse r, the CPU:
   1. Verifies the whistle has blown tests signal s.
   2. Outputs ignition data signal t.
   3. Outputs ignition power signal u.

D. During the period of pulse e"', initiated by the halt reset pulse v, the CPU:
   1. Updates in $E^2$ RAM memory the address of the next to be ignited device.
   2. Resets the decode circuit 204, 208 and 214.
   3. Returns to the start of the program at the beginning of the next ignition cycle for the next to be ignited device.
   4. Resets the fire validate circuit, signal g.

E. The CPU programmed instructions turns the CPU off terminating the period of each of the e signal pulses the CPU being turned on at each ignition cycle by a set of external timing signals initiated by the receipt of a valid fire command signal h.

The lockout circuit signal c resets the reset input of the CPU so the CPU will be disabled and can not generate an output. Signal c also resets the halt circuit 200 so as to preclude the circuit from generating a signal n pulse which otherwise enables the CPU.

At the end of the two second audio whistle, the CPU is enabled by signal r and whistle validate circuit which has been reset by signal r which generated signal s and which causes signal n" to be generated. If the whistle validate is not valid the CPU via the programmed instruction resets the whistle validate signal w, fire validate and halt circuits and returns to the start of the program. If the whistle validate is valid, the CPU outputs the eight bit code word signal t to the output decode circuits 204 and 206.

An ignition signal u' s applied to the next device to be ignited. The output matrix circuit signal v resets the halt circuit 200 at the end of a device ignition cycle generating period e"'. The decode circuits 204 and 214 may be National Semiconductor (NS) decodes 4028 and circuit 206 may be a NS decodes 4514.

In FIG. 16, the method as to how the numbers are sequenced by the CPU during period e"' is shown. The computer program, loaded in the ROM of the CPU, has instructions which test for a valid fire signal step 1600. If a valid fire signal is received, a number representing the particular sequence position (i.e., the address) of a given pyrotechnic device in a magazine, is loaded from the $E^2$RAM into the CPU accumulator (not shown), step 1602. The program then tests in step 1604 the number to see whether or not that number is equal to or less than 5. If the number is less than 5, the computer program instructs the computer to increment the number in the accumulator to the next number, step 1606. For example, assume that the sequence number at step 1604 in a sequence of numbers 0–59 is number 1. That number is incremented to the next number 2. The program outputs number 2 to the decode circuits 204 and 206, step 1608. The incremented number number 2 is stored in $E^2$RAM memory, step 1610, and the program loops around to step 1600. Upon the next fire signal, step 1600, the number stored in $E^2$ RAM is loaded into the accumulator. If that number is less than 5 which in this case would be 3, step 1604, the number is incremented, step 1606, and the loop continues. When the number that is loaded in the RAM from the $E^2$ RAM is equal to or greater than 5 the system goes to the next loop, loop 2, step 1612.

The next loop, e.g., loop 2, performs a similar sequence except that it tests for the number in each $E^2$ RAM location 1 for a number equal to or greater than 10. If the number is not equal to or greater than 10 then the numbers in $E^2$ RAM at location 1 are incremented at each fire command signal until they become 10. When the number 10 is reached at the next fire command signal the system goes to the next loop, step 1614. The next loop, e.g., loop 3, tests for the number equal to or greater than 15 and so on until all of the numbers representing all of the locations in the magazines are tested. Loop 1 applies the addresses for the first 5 pyrotechnic devices in the sequence to RAM location 0 incremently so RAM location 0 stores only one pyrotechnic device address at a time. Loop 2 outputs the pyrotechnic addresses for the next five devices in a sequence to be fired to RAM location 1, one address at a time, each address being incremented as the next round is fired. Loop 3 stores the addresses for the next 5 pyrotechnic devices to be fired and so on.

The numbers that are incremented in the $E^2$ RAM in the third loop represent a range of locations of pyrotechnic devices in a sequence of 10–14 whereas loop four is associated with the sequence of devices in location 15–19 and so on. The addresses remain in the $E^2$ RAM even when the apparatus power is turned off. It is that number which is remembered when the time comes for the unit to be turned on. It is that number which is loaded into the accumulator and tested for its range. Thus, whenever the e''' signal appears, the loading number step is performed. This completes an ignition cycle. When the next ignition command signal 1 is received, the CPU cycles again generate pulses e', e'' and e''' in the next ignition cycle and so on.

The self-test circuit generates 60 firing pulses via its counters and oscillator which pulses are inputted to the fire validate circuit. These pulses are processed by the system as described above with the following exceptions. The output current is limited to the safe test current of the devices without igniting them to test their presence and the whistle time is reduced to a fraction of a second. The self test circuit counter counts the pulse generated until the count reaches 60, terminating the test. Upon completion of the test, a red indicator 193 indicates a failure, i.e., a count of v pulse not equal to 60, and a green indicator 195 indicates an operational device, the occurrence of 60 v pulses. It is estimated that the $E^2$ RAM will last approximately 5–10 years. The $E^2$ RAM is included in the National Semiconductor 8720 model. National Semiconductor Corporation 8720 has one model which can be programmed by the user and a second model which is programmed by the manufacturer with programs submitted to the manufacturer by the user.

As described above, the circuit can continue the ignition sequence where left off or can restart the sequence at the beginning. If it is desired to start a firing sequence in a number of different orders so as to ignite devices selectively in any of the magazines, the CPU program can be modified accordingly. Assume magazine 16 contains noise generating pyrotechnic devices, magazine 18 contains white and blue smoke generating devices and magazine 20 contains noise devices larger than the devices of magazine 16. Thus four different selected sequences need be addressed. The CPU 202, the National Semiconductor Corporation CPU mentioned above, has four inputs such as the fire validate input and whistle validate input and two others (not shown) all capable of similar use.

The whistle validate circuit is removed and three other fire validate circuits are used, each coupled to a separate CPU input. Each fire validate circuit is responsive to a different characteristic fire command signal which corresponds to a given pyrotechnic device characteristic to be fired. The program in the CPU test these inputs and addresses the appropriate device in an array of devices of that characteristic in sequence. It does not matter if the sequence occurs in one or more magazines when a particular input is valid, e.g., the 1 output signal of that validate circuit goes low. Upon receipt of a given fire command signal only one validate circuit out of four different circuits will generate a valid fire command signal. When that particular CPU input goes low, the ROM programmed instructions tell the CPU to address a given device in a given firing sequence for a group of devices selected by that fire command signal. For example, one fire command signal corresponds to one group of devices in one magazine, a second fire command signal corresponds to a second group of devices which may be in that magazine or another magazine and so on. Thus the system can not only ignite devices selectively at a beginning of a sequence, but can selectively fire different groups of devices in different sequences as desired.

While the embodiment described is specific to one implementation, it should be understood that this is for purpose of illustration and not limitation. It should also be understood that the term "ignition cycle" as used in the claims is not limited to an ignition cycle for one device as described herein but may include a group of cylically occurring "ignition cycles" or to a group of selected "cycles", i.e., a group of events that cylically repeat.

What is claimed is:

1. A pyrotechnic device ignition apparatus for igniting a plurality of pyrotechnic devices received in a magazine comprising:

a housing arranged to receive said magazine;

a plurality of spaced electrical contacts for engaging said received devices;

securing means for securing the contacts to the housing;

a plate member secured to the housing in overlying relation to said securing means and having at least one aperture therethrough through which said contacts protrude for engaging said received devices;

circuit means coupled to the housing for applying at least one device ignition signals to said contacts; and a gasket between said securing means and said overlying plate member.

2. The apparatus of claim 1 wherein the gasket is arranged to seal said securing means to said plate member.

3. The apparatus of claim 1 wherein the securing means comprises a printed circuit board, said contacts each comprising a body and contact tip member secured to the body, the body being secured to the circuit board, said gasket for sealing the circuit board to the plate member at at least said at least one aperture.

4. A pyrotechnic device ignition apparatus for igniting an array of a plurality of pyrotechnic devices received in a magazine comprising:

a housing arranged to receive said magazine;

a plurality of spaced electrical contacts arranged in the array for engaging said received devices;

a printed circuit board for securing the contacts to the housing in said array in fixed electrically isolated spaced relation;

a plate member secured to the housing in overlying relation to said circuit board and having an array of apertures therethrough through which said contacts protrude for engaging said received devices;

circuit means coupled to the housing for applying a device ignition signal to each said contacts; and a gasket between said printed circuit board and said overlying plate member for sealing the printed circuit board to the plate member.

5. The pyrotechnic ignition apparatus of claim 4 wherein the gasket comprises a member with at least one aperture through which said array of contacts pass.

6. The apparatus of claim 4 wherein the gasket is arranged to hermetically seal the circuit board to the plate member.

* * * * *